US005211911A

United States Patent [19]

Hayase et al.

[11] Patent Number: 5,211,911

[45] Date of Patent: May 18, 1993

[54] HIGH VANADIUM AUSTENITIC HEAT RESISTANT ALLOY

[75] Inventors: Yozo Hayase, Kobe; Yoshiatsu Sawaragi, Nishinomiya; Shigemitsu Kihara, Tokyo, all of Japan; Wate T. Bakker, Saratoga, Calif.

[73] Assignee: EPRI, Palo Alto, Calif.

[21] Appl. No.: 848,026

[22] Filed: Mar. 9, 1992

[51] Int. Cl.[5] ..... C22C 30/00

[52] U.S. Cl. ..... 420/584.1; 420/452

[58] Field of Search ..... 420/584.1, 452

[56] References Cited

U.S. PATENT DOCUMENTS 4,035,182 7/1977 Kowaka et al. ..... 420/584.1

FOREIGN PATENT DOCUMENTS 109350 5/1984 European Pat. Off. ..... 420/584.1

*Primary Examiner*—Deborah Yee

*Attorney, Agent, or Firm*—Heller, Ehrman, White & McAuliffe

[57] ABSTRACT

High-vanadium austenitic alloys, which are structurally stable and have improved corrosion resistance in wet corrosive environments and high-temperature corrosion resistance in reducing atmosphere, contain Ni by 33.0 to 60.0 weight %, Cr by 23.0 to 28.0 weight %, V by 2.4 to 5.0 weight %, C by 0.10 weight % or less, N by 0.05 weight % or less, Si by 0.35% weight % or less, Al by 0.5 weight % or less, Mn by 1.5% weight % or less, P by 0.020 weight % or less, S by 0.005 weight % or less, and one or more selected from the group consisting of B by 0.0010 to 0.010 weight %, Zr by 0.010 to 0.06 weight %, Ti by 0.03 to 0.50% weight %, and Nb by 0.05 to 1.0 weight %, the balance being Fe and impurities.

6 Claims, 3 Drawing Sheets

HIGH VANADIUM AUSTENITIC HEAT RESISTANT ALLOY

BACKGROUND OF THE INVENTION

This invention relates to a high-vanadium (high-V) austenitic heat-resistant alloy with improved overall corrosion resistance and pitting corrosion resistance. More particularly, this invention relates to such an alloy suited for use in equipment which may be operated in severe environmental conditions such as those which may exist at coal gasification plants.

A high-temperature reducing atmosphere of 500° to 700° C. containing HCl and/or $H_2S$ may be found, for example, in superheater tubes used in coal gasification plants. When such a plant is shut down, a wet corrosive environment may present itself. An alloy for equipment for use in such a plant is required to have both superior high-temperature corrosion resistance and superior overall surface corrosion resistance as well as aqueous corrosion resistance.

It has been known that the chromium (Cr) content of an alloy must be increased in order to effectively improve the corrosion resistance of materials made of such an alloy in high-temperature reducing atmospheres. It has also been known that addition of molybdenum (Mo), in addition to an increase in the Cr content, is an effective way to improve corrosion resistance in wet corrosive environments. Since Mo is detrimental to corrosion resistance in high-temperature reducing atmospheres, however, the addition of Mo is not practical for equipment such as superheater tubes in coal gasification plants.

It was recently disclosed by W. T. Bakker and R. A. Perkins ("Corrosion," NACE International Forum, Paper No. 525 (1989)) that vanadium (V) is not only effective in improving the corrosion resistance of alloys in wet corrosive environments but also capable of improving their corrosion resistance in high-temperature reducing atmospheres. The structural stability and high-temperature strength of high-V austenitic alloys after a long-term high-temperature service, however, have not been sufficiently investigated. One of primary reasons why these materials have not been utilized in high-temperature equipment may be their inferior corrosion resistance in oxidizing atmospheres. Another may be the fact that V is an element having a strong propensity to promote ferrite, and that it also promotes the precipitation of intermetallic compounds, typified by the sigma ($\sigma$) phase.

Thus, although it is necessary to increase the Cr content in the alloy and a very large quantity of V must be added to such a high chromium austenitic alloy, it is a major problem to maintain structural stability when the alloy is used for long periods of time at high temperatures. Carbides and nitrides, which contain large quantities of V, tend to precipitate out during use in high-temperature environments if large quantities of V are added. This is because V has strong affinity to C and N, and this has the adverse effect of reducing the quantity of solid solution V, thereby also reducing the corrosion resistance. The precipitated vanadium carbonitrides may affect the toughness and creep rupture strength during a long-term exposure.

SUMMARY OF THE INVENTION

It is an object of the present invention to provide alloys having both improved corrosion resistance in wet corrosive environments and improved high-temperature corrosion resistance in reducing atmospheres.

It is another object of the present invention to provide structurally stable heat-resistant high-V austenitic alloys.

It is still another object of the present invention to provide such alloys which can be used as heat exchanger component having improved high-temperature corrosion resistance above 500° C. in reducing atmospheres containing HCl and $H_2S$ as are found, for example, in syngas coolers of coal gasification plants.

This invention is based in part on the present inventors' discovery that in high-Cr austenitic alloys containing 23 weight % or more of Cr and a large quantity (say, 2.5 weight % or greater) of V, the addition of trace quantities of one or more of B, Zr, Ti and Nb is effective in maintaining superior creep rupture strength. Another discovery by the inventors, upon which the present invention is based, is that reducing the quantity of Si in such an alloy is effective in controlling the decrease in toughness due to the precipitation of vanadium carbides and nitrides, as well as the precipitation of intermetallic compounds such as $\sigma$ phase.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

Figure 1:
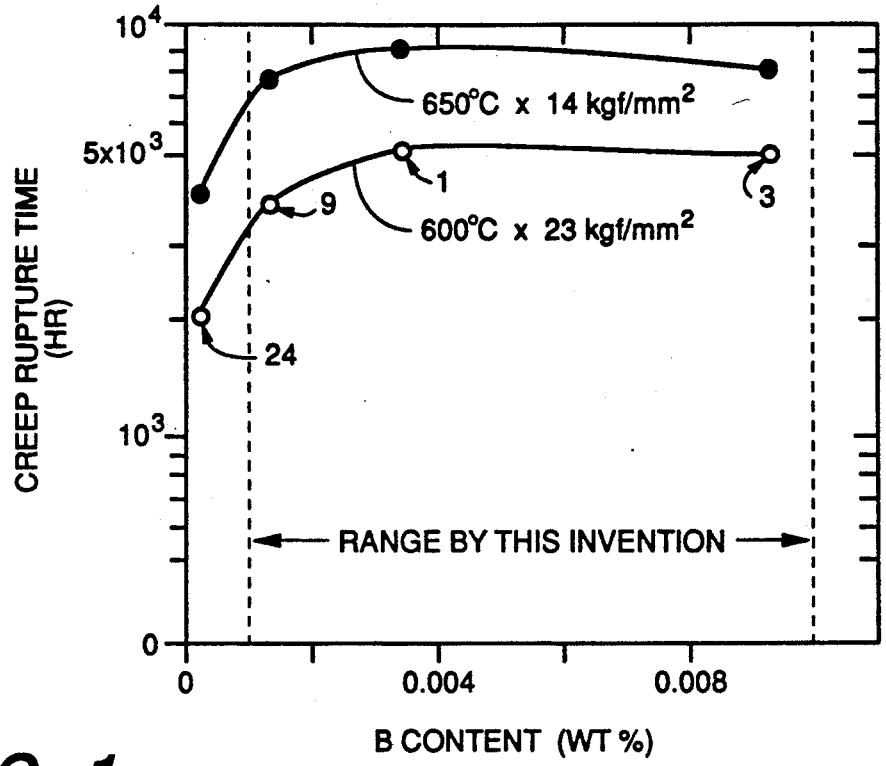
FIG. 1 is a graph showing the relationship between creep rupture time and the B content in tested samples.
Figure 2:
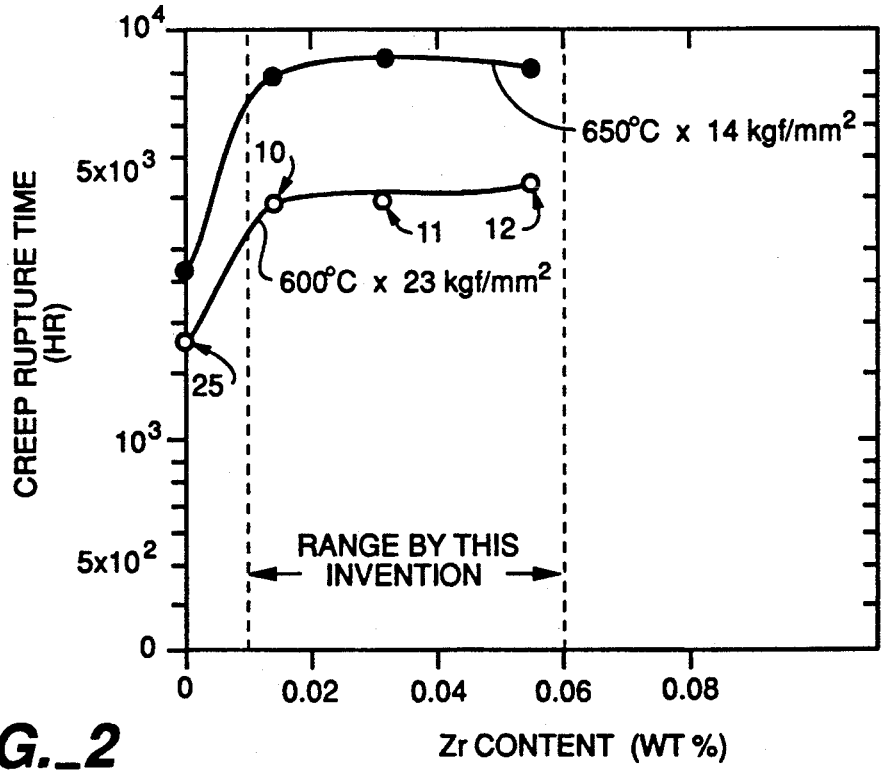
FIG. 2 is a graph showing the relationship between creep rupture time and the Zr content in tested samples.
Figure 3:
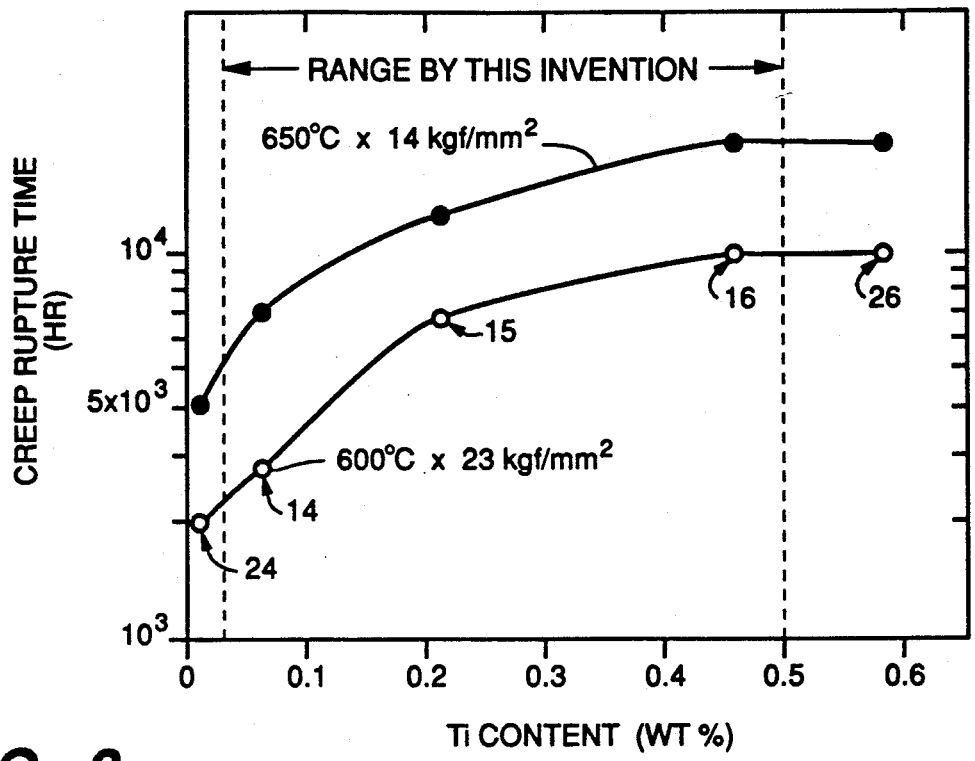
FIG. 3 is a graph showing the relationship between creep rupture time and the Ti content in tested samples.
Figure 4:
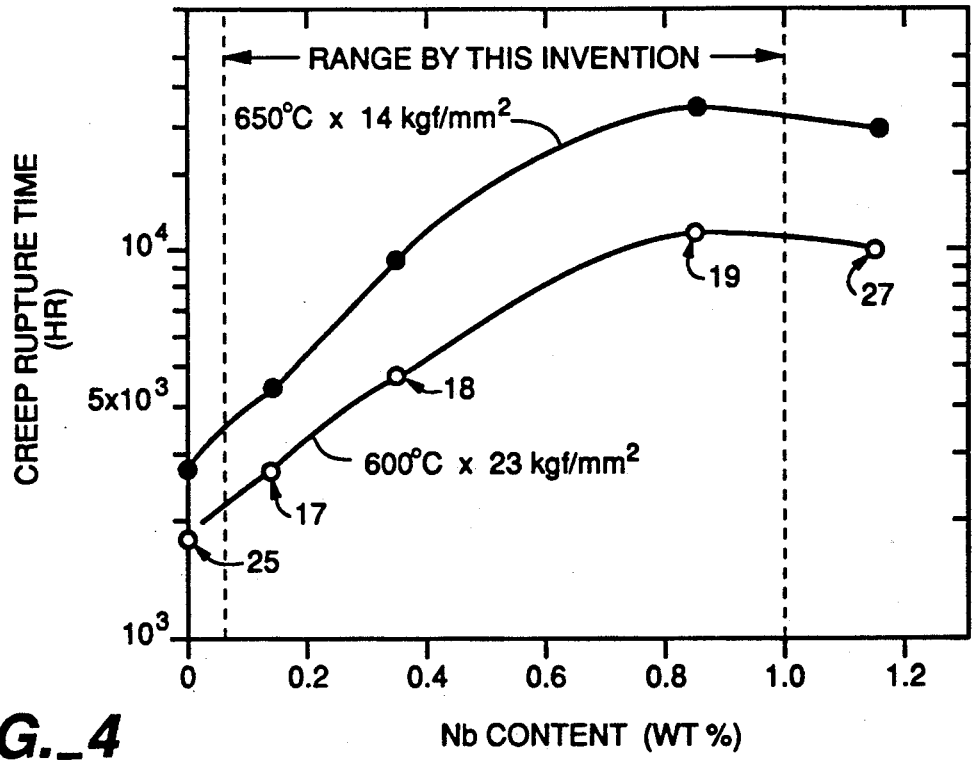
FIG. 4 is a graph showing the relationship between creep rapture time and the Nb content in tested samples.

The numerals in these Figures indicate the corresponding sample Nos. as defined in Table 1.

DETAILED DESCRIPTION OF THE INVENTION

High-V austenitic heat-resistant alloys according to the present invention, with which the above and other objects can be attained, may be characterized as possessing an alloy composition as follows:

Ni: 33.0 to 6.0 weight %;
Cr: 23.0 to 28.0 weight %;
V: 2.4 to 5.0 weight %;
C: 0.10 weight % or less;
N: 0.05 weight % or less;
Si: 0.35% weight % or less; Al: 0.5 weight % or less;
Mn: 1.5% weight % or less;
P: 0.020 weight % or less;
S: 0.005 weight % or less;

One or more selected from the group consisting of:
B: 0.0010 to 0.010 weight %,
Zr: 0.010 to 0.06 weight %,
Ti: 0.03 to 0.50% weight %, and
Nb: 0.05 to 1.0 weight %; and
Balance being Fe and impurities.

Nickel (Ni) is an element which is essential for the stabilization of the austenite structure. Alloys according to the present invention are required to contain Ni by at least 33.0 weight %. The upper limit to the Ni content according to the invention is set at 60.0% to restrain cost increases.

Chromium (Cr) is an element capable of effectively improving corrosion resistance in high-temperature reducing atmospheres and wet corrosive environments. In order to fully develop these effects, however, its content should be 23.0 weight % or more according to this invention. If the Cr content exceeds about 28.0 weight %, on the other hand, workability of the high-V austenitic alloys of the type considered herein is affected adversely, making it difficult to stabilize the austenite structure during long-term service.

Vanadium (V), as stated above, is an essential element for improving the corrosion resistance in high-temperature reducing atmospheres and wet corrosive environments, and a V content of at least 2.5% is necessary to fully develop its effects for the purpose of the present invention. If the V content exceeds about 5.0 weight %, however, not only do workability and weldability diminish, but toughness of the alloy is also markedly reduced.

Alloys according to the present invention do not contain carbon (C) by more than 0.10% because, although C is an element which is effective in increasing the tensile strength and creep rupture strength necessary for heat-resistant alloys, large quantities of vanadium carbides are formed if an excessive amount (say, over 0.10 weight %) of C is added. As explained above, formation of too much vanadium carbides leads to a decrease in the quantity of solid solution V, as well as in toughness and corrosion resistance of the alloy.

Nitrogen (N), having a higher solid solution limit than C, is an element which is effective both in stabilizing the austenite structure and in contributing improved creep rupture strength. However, if more than about 0.05 weight % N is present in an high-V austenitic alloy according to the present invention, large quantities of nitrides of V precipitate under solution heat treatment conditions and during high-temperature service, causing excessive losses in toughness and malleability during high-temperature service. In general, the N content should be as low as possible.

Figure 5:
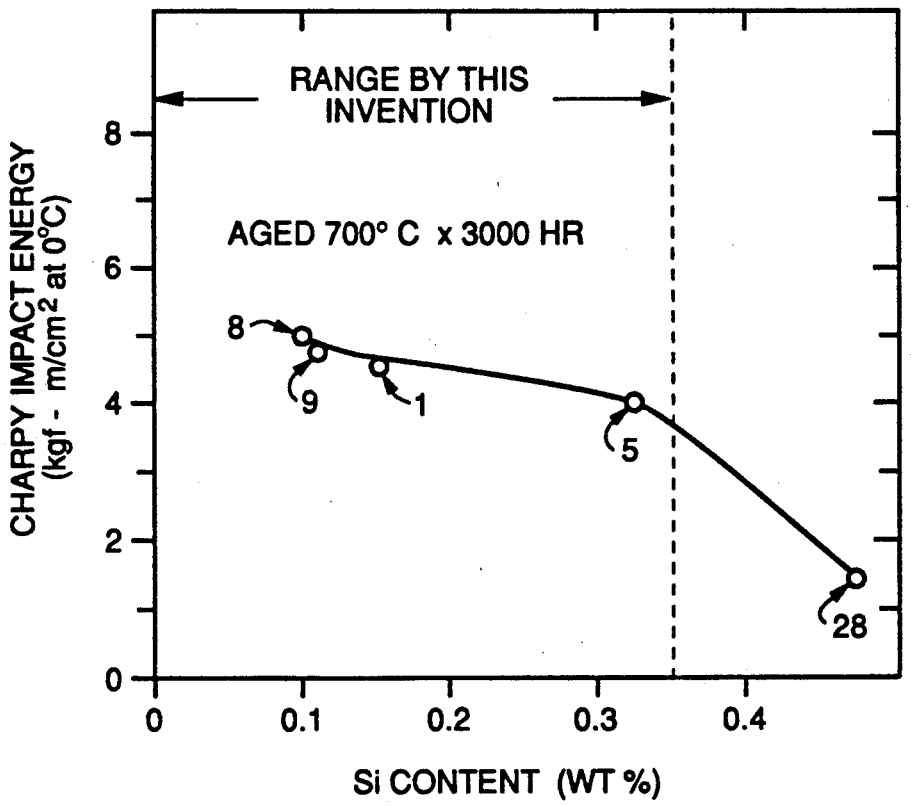
FIG. 5 is a graph showing the relationship between impact value after aging and the Si content in test samples.

As for silicon (Si), which is an element known to be effective as a deoxidizer, its presence must be restricted to 0.35 weight % or less, to prevent excessive precipitation of intermetallic compounds and V carbides and nitrides, as this will reduce toughness. Additions below 0.35 weight % do not adversely affect toughness, as can be seen in FIG. 5. Similarly, manganese (Mn) is added as an element which is effective as a deoxidizer capable of improving workability. In order to maintain toughness in high-temperature service, however, the Mn content should not be over 1.5%.

Aluminum (Al) is similarly known as an effective deoxidizer, but precipitation of intermetallic compounds, such as $\sigma$ phase, will increase and toughness of the alloy will be adversely affected if the Al content in the alloy exceeds about 0.5%.

The phosphorus (P) and sulfur (S) contents should be as low as possible from the standpoint of weldability. Since it is costly to reduce the P and S content excessively, their maximum allowable limits, according to the present invention, are 0.020 weight % and 0.005 weight %, respectively, in order not to incur an unreasonably high expense while avoiding any practical sacrifices in weldability.

From the point of view of this invention, boron (B), zirconium (Zr), titanium (Ti) and niobium (Nb) are considered as elements capable of improving creep rupture strength if one or more of them are added to an alloy. More in detail, B and Zr are both elements capable of effectively strengthening grain boundaries and refining vanadium carbides inside the grains, thereby improving high-temperature strength and, in particular, creep rupture strength of the alloy. In order to fully develop these effects, however, the minimum B content should be about 0.0010 weight % and the minimum Zr content should be about 0.010 weight %. On the other hand, weldability of the alloy is adversely affected if the B content exceeds about 0.010 weight % or the Zr content exceeds about 0.06 weight %.

As for Ti and Nb, they are elements effective in the refinement of carbides, such as $M_{23}C_6$, and in the fine precipitation of MC-type carbides, such as TiC and NbC, improving creep rupture strength of the alloy. In order to fully develop these effects, however, the minimum Ti content should be about 0.03 weight % and the minimum Nb content should be about 0.05 weight %. On the other hand, the creep rupture strength drops again and the quantity of intermetallic compound precipitates, such as $\sigma$ phase, increases during high-temperature service, adversely affecting toughness, if the Ti content exceeds about 0.50 weight % or the Nb content exceeds about 1.0%.

The high-V austenitic heat-resistant alloy of the present invention, with composition as described above, can be formed into desired high-temperature equipment components by melting the alloy and casting ingots, and then hot rolling, extruding or forging and, if necessary, cold rolling, drawing or pilgering the ingots into pipes, rods or bars.

In what follows, the present invention will be explained in further detail by way of experimental results on test samples. It is to be remembered, however, that these examples are intended to be illustrative, and not as limiting the scope of the invention.

Experiments

With reference to Table 1, 50 kg each of the compositions described therein were melted in a vacuum high-frequency furnace, molded into ingots, forged and then cold rolled to obtain plates 10 mm thick. Subsequently, these plates were solution-heat-treated, that is, heated to 1150° C. and then quenched with water, yielding Samples Nos. 1 through 28. Samples Nos. 1 through 24 are alloys embodying the present invention. Samples Nos. 25 through 28 are for comparison.

The samples, thus prepared, were tested for their creep rupture characteristics and their structural stability after high-temperature service. The creep rupture characteristics were evaluated through creep rupture testing under conditions of 600° C.×23 kgf/mm$^2$ and 650° C.×12 kgf/mm$^2$. Structural stability was evaluated by Charpy impact testing at 0° C. for each sample after 3000 hours of aging at 700° C. The results of these tests are also shown in Table 1.

The relationships between creep rupture time and the contents of B, Zr, Ti and Nb are shown in FIGS. 1 through 4. The relationship between the impact value after aging and Si content is shown in FIG. 5. As is clear from FIGS. 1 though 4, the addition of one or more elements selected from the group consisting of B, Zr, Ti and Nb according to the present invention is extremely effective in improving the creep rupture life of high-Cr, high-V austenitic alloys considered herein.

The effect of Ni content on creep rupture life is not certain from Samples Nos, 1 through 4. Samples Nos. 1 through 9 and 28 indicate, on the other hand, that toughness can be vastly improved if the Si content is limited, say, to 0.35 weight % or less.

In summary, high-Cr, high-V austenitic alloys according to the present invention are shown to have significantly improved creep rupture strength and structural stability after aging. Thus, such alloys can be advantageously used as a high-strength structural material for high-temperature equipment used in both high-temperature reducing gas atmospheres and wet corrosive environments, which can both exist, for example, in superheaters of coal gasification plants.

The present invention was described above by way of preferred ranges in the contents of critical elements. Minor deviations from these prescribed ranges may occur within the scope of the invention. In other words, the description of the invention provided above is intended to be interpreted broadly, and such modifications and variations, that may be apparent to a person skilled in the art, are intended to be within the scope of the invention.

TABLE 1

| Sample No. | C | Si | Mn | P | S | Ni | Cr | V (Cont'd) |
|---|---|---|---|---|---|---|---|---|
| 1 | 0.05 | 0.15 | 0.52 | 0.016 | 0.002 | 34.8 | 26.5 | 3.3 |
| 2 | 0.06 | 0.17 | 0.50 | 0.016 | 0.001 | 45.2 | 26.3 | 3.2 |
| 3 | 0.06 | 0.17 | 0.49 | 0.015 | 0.002 | 53.8 | 26.5 | 3.3 |
| 4 | 0.02 | 0.18 | 0.60 | 0.017 | 0.002 | 39.2 | 26.0 | 3.2 |
| 5 | 0.05 | 0.33 | 0.60 | 0.016 | 0.001 | 36.3 | 26.5 | 3.5 |
| 6 | 0.05 | 0.16 | 0.48 | 0.017 | 0.001 | 33.4 | 23.4 | 2.7 |
| 7 | 0.05 | 0.16 | 0.67 | 0.015 | 0.002 | 59.2 | 27.6 | 4.7 |
| 8 | 0.05 | 0.10 | 0.43 | 0.016 | 0.003 | 38.5 | 26.0 | 3.3 |
| 9 | 0.06 | 0.11 | 0.43 | 0.016 | 0.003 | 38.3 | 26.2 | 3.3 |
| 10 | 0.05 | 0.10 | 0.61 | 0.012 | 0.002 | 37.5 | 25.8 | 3.2 |
| 11 | 0.05 | 0.09 | 0.65 | 0.011 | 0.002 | 38.0 | 26.0 | 3.0 |
| 12 | 0.06 | 0.10 | 0.60 | 0.012 | 0.002 | 37.6 | 26.0 | 3.4 |
| 13 | 0.09 | 0.15 | 0.60 | 0.015 | 0.002 | 38.5 | 26.5 | 3.3 |
| 14 | 0.05 | 0.21 | 0.97 | 0.011 | 0.003 | 35.2 | 26.0 | 3.5 |
| 15 | 0.05 | 0.20 | 1.00 | 0.012 | 0.001 | 35.5 | 26.3 | 3.4 |
| 16 | 0.05 | 0.18 | 1.11 | 0.012 | 0.002 | 36.0 | 26.5 | 3.4 |
| 17 | 0.07 | 0.28 | 0.98 | 0.016 | 0.002 | 40.0 | 26.5 | 3.0 |
| 18 | 0.06 | 0.27 | 0.98 | 0.017 | 0.002 | 39.6 | 26.0 | 3.0 |
| 19 | 0.07 | 0.25 | 0.98 | 0.018 | 0.003 | 39.8 | 26.1 | 3.1 |
| 20 | 0.04 | 0.10 | 0.60 | 0.016 | 0.002 | 36.0 | 25.9 | 3.3 |
| 21 | 0.05 | 0.10 | 0.52 | 0.016 | 0.002 | 36.3 | 26.3 | 3.4 |
| 22 | 0.05 | 0.15 | 0.48 | 0.014 | 0.002 | 45.6 | 26.5 | 3.8 |
| 23 | 0.05 | 0.16 | 0.58 | 0.014 | 0.002 | 46.3 | 25.8 | 3.7 |
| 24 | 0.05 | 0.16 | 0.50 | 0.014 | 0.002 | 35.3 | 26.3 | 3.3 |
| 25 | 0.07 | 0.25 | 1.00 | 0.011 | 0.002 | 40.2 | 26.0 | 3.1 |
| 26 | 0.05 | 0.14 | 0.56 | 0.015 | 0.002 | 36.0 | 26.3 | 3.4 |
| 27 | 0.05 | 0.15 | 0.64 | 0.015 | 0.003 | 40.5 | 26.5 | 3.2 |
| 28 | 0.05 | 0.48* | 0.60 | 0.015 | 0.002 | 36.3 | 26.3 | 3.3 |

| | Al | N | B | Zr | Ti | Nb | Fe (Cont'd) |
|---|---|---|---|---|---|---|---|
| 1 | 0.13 | 0.025 | 0.0035 | — | — | — | Bal. |
| 2 | 0.14 | 0.023 | 0.0038 | — | — | — | Bal. |
| 3 | 0.12 | 0.027 | 0.0038 | — | — | — | Bal. |
| 4 | 0.12 | 0.030 | 0.0050 | — | — | — | Bal. |
| 5 | 0.04 | 0.019 | 0.0028 | — | — | — | Bal. |
| 6 | 0.10 | 0.045 | 0.0034 | — | — | — | Bal. |
| 7 | 0.43 | 0.025 | 0.0052 | — | — | — | Bal. |
| 8 | 0.12 | 0.013 | 0.0093 | — | — | — | Bal. |
| 9 | 0.13 | 0.016 | 0.0014 | — | — | — | Bal. |
| 10 | 0.05 | 0.039 | — | 0.014 | — | — | Bal. |
| 11 | 0.07 | 0.040 | — | 0.032 | — | — | Bal. |
| 12 | 0.07 | 0.035 | — | 0.056 | — | — | Bal. |
| 13 | 0.12 | 0.036 | 0.0035 | 0.025 | — | — | Bal. |

TABLE 1-continued

| Sample No. | | | | | | | |
|---|---|---|---|---|---|---|---|
| 14 | 0.13 | 0.019 | — | — | 0.06 | — | Bal. |
| 15 | 0.14 | 0.023 | — | — | 0.21 | — | Bal. |
| 16 | 0.11 | 0.028 | — | — | 0.46 | — | Bal. |
| 17 | 0.09 | 0.035 | — | — | — | 0.07 | Bal. |
| 18 | 0.11 | 0.030 | — | — | — | 0.35 | Bal. |
| 19 | 0.10 | 0.038 | — | — | — | 0.85 | Bal. |
| 20 | 0.10 | 0.020 | 0.0028 | — | — | 0.18 | Bal. |
| 21 | 0.14 | 0.021 | 0.0032 | 0.028 | — | 0.35 | Bal. |
| 22 | 0.10 | 0.021 | 0.0041 | — | 0.14 | — | Bal. |
| 23 | 0.14 | 0.025 | 0.0045 | — | 0.07 | 0.18 | Bal. |
| 24 | 0.14 | 0.023 | —* | —* | —* | —* | Bal. |
| 25 | 0.10 | 0.038 | —* | —* | —* | —* | Bal. |
| 26 | 0.14 | 0.025 | — | — | 0.58* | — | Bal. |
| 27 | 0.10 | 0.035 | — | — | — | 1.15* | Bal. |
| 28 | 0.10 | 0.027 | 0.0035 | — | — | — | Bal. |

| | Creep Rupture Time (h) | | Charpy Impact |
|---|---|---|---|
| | 600° C. × 23 kgf/mm² | 650° C. × 14 kgf/mm² | Energy (kgf-m/cm²) After 700° C. × 3000 h |
| 1 | 5112.0 | 8973.5 | 4.5 |
| 2 | 5100.5 | 9263.0 | 6.0 |
| 3 | 4978.6 | 9418.5 | 8.0 |
| 4 | 4877.5 | 8418.7 | 5.0 |
| 5 | 5616.5 | 8874.3 | 4.0 |
| 6 | 4815.7 | 8248.5 | 6.0 |
| 7 | 5001.3 | 9579.8 | 3.8 |
| 8 | 4900.0 | 7918.5 | 5.0 |
| 9 | 3786.3 | 7685.0 | 4.8 |
| 10 | 3996.5 | 7963.3 | 5.2 |
| 11 | 3914.0 | 8748.6 | 5.5 |
| 12 | 4372.3 | 8118.0 | 5.5 |
| 13 | 7863.5 | 11985.6 | 5.0 |
| 14 | 2700.7 | 6949.7 | 4.5 |
| 15 | 6598.3 | 12300.5 | 4.3 |
| 16 | 9814.5 | 18996.0 | 4.0 |
| 17 | 2690.6 | 4400.8 | 5.3 |
| 18 | 4811.1 | 9587.5 | 4.5 |
| 19 | 11086.5 | 23100.5 | 3.8 |
| 20 | 7564.5 | 13869.0 | 5.0 |
| 21 | 15965.6 | 24760.5 | 4.8 |
| 22 | 8987.5 | 13396.9 | 4.5 |
| 23 | 9274.0 | 14774.7 | 4.7 |
| 24 | 1978.3 | 3985.0 | 3.5 |
| 25 | 1810.0 | 2715.3 | 3.5 |
| 26 | 9806.9 | 18865.0 | 2.8 |
| 27 | 10006.5 | 19585.0 | 2.5 |
| 28 | 4987.6 | 7863.5 | 1.5 |

Notes:
Samples Nos. 1 through 23 are according to this invention.
Samples Nos. 24 through 28 are for comparison.
"Bal." indicates balance.
"*" indicates outside the range according to this invention.

What is claimed is:

1. An alloy consisting essentially of Ni by 33.0 to 60.0 weight %, Cr by 23.0 to 28.0 weight %, V by 2.4 to 5.0 weight % and one or more selected from the group consisting of B by 0.0010 to 0.010 weight %, Zr by 0.010 to 0.06 weight %, Ti by 0.03 to 0.50% weight % and Nb by 0.05 weight % to 1.0 weight %, the balance consisting essentially of iron, said alloy containing no more than 0.35 weight % of Si.

2. The alloy of claim 1 containing no more than 0.10 weight % of C.

3. The alloy of claim 2 containing no more than 0.05 weight % of N.

4. The alloy of claim 3 containing no more than 0.020 weight % of P and no more than 0.005% weight % of S.

5. The alloy of claim 4 containing no more than 0.5 weight % of Al and no more than 1.5 weight % of Mn.

6. The alloy of claim 1 of which Charpy impact energy tested at 0° C. is greater than 3.8 kgf-m/cm² after 300 hours of aging at 700° C.

* * * * *